US009683361B2

(12) United States Patent
Timberlake et al.

(10) Patent No.: US 9,683,361 B2
(45) Date of Patent: Jun. 20, 2017

(54) METHOD AND SYSTEM FOR RAPID CONSTRUCTION OF STRUCTURALLY REINFORCED CONCRETE STRUCTURES USING PREFABRICATED ASSEMBLIES AND METHOD OF MAKING THE SAME

(71) Applicant: KT-INDIA, LLC, Moylan, PA (US)

(72) Inventors: James Timberlake, Philadelphia, PA (US); Billie Faircloth, Philadelphia, PA (US); Taylor Medlin, Philadelphia, PA (US); Rob Schaeffer, King of Prussia, PA (US); Jon Morrison, King of Prussia, PA (US); Chris MacNeal, Philadelphia, PA (US); Peter Curry, Philadelphia, PA (US)

(73) Assignee: KT-INDIA, LLC, Moylan, PA (US)

( * ) Notice: Subject to any disclaimer, the term of this patent is extended or adjusted under 35 U.S.C. 154(b) by 0 days.

(21) Appl. No.: 14/890,021

(22) PCT Filed: May 1, 2014

(86) PCT No.: PCT/US2014/036391

§ 371 (c)(1),
(2) Date: Nov. 9, 2015

(87) PCT Pub. No.: WO2014/182539

PCT Pub. Date: Nov. 13, 2014

(65) Prior Publication Data

US 2016/0122996 A1 May 5, 2016

Related U.S. Application Data

(60) Provisional application No. 61/820,969, filed on May 8, 2013.

(51) Int. Cl.
*E04B 1/04* (2006.01)
*E04B 1/16* (2006.01)
(Continued)

(52) U.S. Cl.
CPC ..... *E04B 1/167* (2013.01); *E04B 1/161* (2013.01); *E04B 1/165* (2013.01); *E04B 5/36* (2013.01);
(Continued)

(58) Field of Classification Search
CPC . E04B 1/04; E04B 1/165; E04B 1/161; E04B 5/04; E04B 5/38; E04B 5/43;
(Continued)

(56) References Cited

U.S. PATENT DOCUMENTS 4,081,935 A * 4/1978 Wise ..... E04B 5/43 52/236.8
4,409,764 A * 10/1983 Wilnau ..... E04B 1/165 52/127.3
(Continued)

FOREIGN PATENT DOCUMENTS

WO 2010014557 A1 2/2010

OTHER PUBLICATIONS

International Search Report of PCT/US2014/036391 dated Feb. 15, 2016.

*Primary Examiner* — Rodney Mintz
*Assistant Examiner* — Daniel Kenny
(74) *Attorney, Agent, or Firm* — Caesar Rivise, PC

(57) ABSTRACT

The present invention includes prefabricated assemblies which are assembled on a construction site to provide a permanent concrete mold with integrated structural reinforcement and structural splices for cast-in-place concrete structures. The invention enhances the quality of the cast concrete structure while lowering the cost of construction and construction time. Described herein is a column form assembly, a column closure panel assembly, a beam form assembly, and a slab form assembly which are used to construct cast in place structurally reinforced concrete col-
(Continued)

umns, beams, and floor slabs with minimal form work and construction site logistics. Also described herein are a method of assembly of said structures and a method of fabricating said assemblies.

17 Claims, 17 Drawing Sheets

(51) Int. Cl.

| | |
|---|---|
| ***E04C 5/06*** | (2006.01) |
| ***E04B 5/36*** | (2006.01) |
| ***E04B 5/38*** | (2006.01) |
| ***E04C 2/06*** | (2006.01) |
| ***E04C 2/22*** | (2006.01) |

(52) U.S. Cl.
CPC ..... *E04B 5/38* (2013.01); *E04C 2/06* (2013.01); *E04C 2/22* (2013.01); *E04C 5/0604* (2013.01)

(58) Field of Classification Search
CPC ... E04B 5/046; E04B 5/36; E04B 5/40; E04B 1/163; E04B 1/24; E04B 1/34823; E04B 2001/2484
See application file for complete search history.

(56) References Cited

U.S. PATENT DOCUMENTS

| | | | | |
|---|---|---|---|---|
| 4,505,087 | A * | 3/1985 | Sarda | E04B 5/43 264/31 |
| 4,616,459 | A * | 10/1986 | Shubow | E04B 1/163 52/236.8 |
| 5,507,124 | A * | 4/1996 | Tadros | E04B 5/43 52/251 |
| 6,293,063 | B2 * | 9/2001 | Van Doren | 52/250 |
| 6,568,139 | B2 * | 5/2003 | Bot | E01D 19/125 52/125.5 |
| 6,625,943 | B1 * | 9/2003 | Renner | E04B 1/165 52/250 |
| 2001/0003234 | A1 * | 6/2001 | Van Doren | E04B 1/165 52/251 |
| 2005/0072061 | A1 | 4/2005 | Marty | |
| 2005/0210762 | A1 | 9/2005 | Broberg | |
| 2010/0058687 | A1 | 3/2010 | Normand | |
| 2012/0210669 | A1 | 8/2012 | Lee | |
| 2016/0032580 | A1 * | 2/2016 | Rahimzadeh | E04B 1/30 52/236.9 |

* cited by examiner

METHOD AND SYSTEM FOR RAPID CONSTRUCTION OF STRUCTURALLY REINFORCED CONCRETE STRUCTURES USING PREFABRICATED ASSEMBLIES AND METHOD OF MAKING THE SAME

CROSS-REFERENCE TO RELATED APPLICATIONS

This PCT application claims the benefit under 35 U.S.C. §119(e) of Provisional Patent Application Ser. No. 61/820,969 filed on May 8, 2013 entitled METHOD AND SYSTEM FOR RAPID CONSTRUCTION OF STRUCTURALLY REINFORCED CONCRETE STRUCTURES USING PREFABRICATED ASSEMBLIES AND METHOD OF MAKING THE SAME and whose entire disclosure is incorporated by reference herein.

The claimed invention was made by, on behalf of, and/or in connection with the following parties to a joint research agreement: KT-India LLC and CVM Engineers. The joint research agreement was in effect on or before the date the claimed invention was made, and the claimed invention was made as a result of activities undertaken within the scope of the joint research agreement.

BACKGROUND OF THE INVENTION

1. Field of Invention

This invention relates to precast concrete components of structures and prefabricated structural reinforcement of cast in place concrete structures.

2. Description of Related Art

Precast structural concrete is commonly used by those skilled in the art to rapidly assemble buildings, roads, bridges, and other structures. Precast components and prefabricated structural reinforcement minimize logistical burden, cost, and assembly time of construction as compared to other conventional techniques of assembling with smaller components in the field. These components are manufactured in a factory oftentimes to higher levels of complexity than what is achievable in the field. Precast components in particular are used where a high degree of quality control, minimized assembly time on site, and highly repetitive components are necessary in the construction of a structure.

Techniques such as casting in place of structurally reinforced concrete are typically used for larger reinforced concrete structural components such as columns and slabs, and are facilitated by removable formwork and prefabricated structural reinforcement.

Under certain circumstances described herein, the logistic advantages of both cast in place concrete and precast concrete are desired. To this end, the inventors provide a novel method to assemble reinforced concrete structures using a non-removable formwork composed of structural elements and prefabricated structural reinforcement.

Prefabrication is a means of achieving high levels of quality at low cost in a mass production environment. Prefabrication allows the designer to achieve higher levels of complexity with regard to system integration, surface finish, and customization in systems and finishes. This complexity is managed in a factory environment. In addition, prefabrication of modular components allows for a variety of designs to be realized using a limited number of standard parts. Prefabrication of systems leads to cost reductions since a limited number of trade skill is present on site and the diversity of building materials at the construction site is reduced.

Cast in place reinforced concrete structures are able to achieve a high level of structural integrity at minimal cost. The features of the technique are well known to those skilled in the art, and will not be discussed here. Several notable limitations to conventional cast in place reinforced concrete exist, which the inventors have been able to overcome with the present invention. First, cast in place reinforced concrete requires the manipulation of formwork and mold components, which can be burdensome and complex for low skill labor on construction sites. Manipulating this formwork on site also entails proper placement of structural reinforcement, which again is a burden to low skill labor. Some notable examples of structural failure familiar to those skilled in the art include cases in which on site labor neglected to include structural reinforcement, leading to catastrophic failure. Further, the designer has little control over the quality of the concrete available on site, particularly with regard to construction sites in developing countries. Conventional cast in place concrete structures result in a surface finish which is dependent on the quality of the concrete on site, the surface finish and condition of the formwork, and the skill of the on-site labor, which again limits the quality attainable by conventional cast in place concrete. By utilizing a permanent leave behind prefabricated formwork with integral structural reinforcement, the present invention is able to overcome the difficulties related to structural integrity and quality due to construction site factors out of the control of the designer.

Material handling equipment typically used to place large or heavy precast components can be limited to various construction site logistics, so it is often in the interest of the designer to minimize the size or weight of a precast component to facilitate construction. Designs which are limited in the size or weight of a precast component are typically cast in place instead; however, cast in place constructions are limited in the manner discussed previously. Therefore, a lightweight construction which can offer the site logistics of a precast component and can be further cast in place for permanent placement would overcome the logistical burden of excessively large or heavy precast components as well as the quality limitations associated with cast in place concrete structures.

The need to construct concrete structures in certain developing countries is significantly complicated by the lack of available skilled labor and on site quality control measures such as inspections and testing. Many conventional precast concrete structures which are assembled on site make use of integral metal connectors such as threaded rods, joining plates, and bolts. Assembling such conventional precast concrete structures and ensuring the quality of integral connections is burdensome for low skill labor; for example, torque control fastening may not be available on site, a construction site may lack workers with the required training for installing or welding structural connections, a construction site may lack the requisite inspection capacity required for structural connections, or the proper steel finishing techniques for the structural connections may not be accessible in such developing countries. Therefore, precast components that are assembled on site to create leave in place formwork significantly benefit from designs and methods that do not incorporate such conventional metal joining plates, bolts, and the like. The present invention is able to overcome the quality limitations of these conventional components by providing novel components which are inserted into one another and subsequently filled with concrete for proper assembly without the need for conventional metal joints.

The assembly of precast components on a construction site can be optimized to enhance construction speed by minimizing the need for temporary fastening, bracing, and shoring of precast components prior to adding the concrete infill. The present invention incorporates precast column form assemblies and column closure panel assemblies that do not require the temporary fastening, strapping, and clamping provisions necessary for conventional concrete formwork. Construction speed can be further optimized by limiting the number of operations which must be completed by a crane before pouring concrete. The present invention provides components which incorporate the structural reinforcement, further enhancing construction speed.

Due to the limitations of conventional techniques described herein, the inventors have made a novel invention to overcome said limitations and result in high quality construction with minimized logistical burden and cost.

BRIEF SUMMARY OF THE INVENTION

A first aspect of the invention is a construction method comprising: (a) providing prefabricated assembly components comprising a column form assembly, a column closure panel assembly, a beam form assembly, and a slab form assembly; (b) assembling on a construction site the prefabricated assembly components to provide a permanent concrete mold on the construction site, wherein the permanent concrete mold has integrated structural reinforcement and structural splices for a cast in place concrete structure; and (c) casting concrete in the permanent concrete mold to provide the cast in place concrete structure.

In certain embodiments of the first aspect of the invention, the prefabricated assembly components comprise a shaped form and integrated structural reinforcement, wherein the shaped form comprises at least one formed material selected from the group consisting of concrete, fiber reinforced plastic, and molded plastic.

In certain embodiments of the first aspect of the invention, the shaped form comprises a concrete formulation having a density no greater than 160 pounds per cubic foot and comprising: (i) cement; (ii) water; (iii) a reinforcing matrix; and (iv) an aggregate comprising at least one member selected from the group consisting of an expanded polymeric foam, hollow glass spheres, hollow ceramic spheres, expanded silica, fumed silica, expanded shale, expanded clay, foamed glass, vermiculite and perlite.

In certain embodiments of the first aspect of the invention, the reinforcing matrix comprises at least one member selected from the group consisting of glass fiber, polyethylene fiber, polyvinylacetate fiber, polypropylene fiber, polyamide fiber and steel wire.

In certain embodiments of the first aspect of the invention, the integrated structural reinforcement comprises a material selected from the group consisting of steel bars, steel wire, carbon fiber reinforced composite bars, glass fiber reinforced composite bars, aramid fiber reinforced composite bars, bamboo, and perforated steel sheet.

In certain embodiments of the first aspect of the invention, the prefabricated assembly components comprise keying geometries adapted to restrict improper assembly on site.

In certain embodiments of the first aspect of the invention, the column form assembly accepts the column closure panel assembly by way of an internal slot.

In certain embodiments of the first aspect of the invention, the integrated structural reinforcement is applied to the shaped form and partially exposed, allowing for subsequent reinforcement of an additional concrete infill.

In certain embodiments of the first aspect of the invention, the integrated structural reinforcement is applied to the shaped form by casting or by fastening.

A second aspect of the invention is a prefabricated assembly component comprising: (a) a shaped form comprising at least one formed material selected from the group consisting of concrete, fiber reinforced plastic, and molded plastic; (b) an integrated structural reinforcement comprising a material selected from the group consisting of steel bars, steel wire, carbon fiber reinforced composite bars, glass fiber reinforced composite bars, aramid fiber reinforced composite bars, bamboo, and perforated steel sheet; and (c) keying geometries adapted to restrict improper assembly with other prefabricated assembly components, wherein the prefabricated assembly component is a member selected from the group consisting of a column form assembly, a column closure panel assembly, a beam form assembly, and a slab form assembly.

In certain embodiments of the second aspect of the invention, the shaped form comprises a concrete formulation having a density no greater than 160 pounds per cubic foot and comprising: (i) cement; (ii) water; (iii) a reinforcing matrix; and (iv) an aggregate comprising at least one member selected from the group consisting of an expanded polymeric foam, hollow glass spheres, hollow ceramic spheres, expanded silica, fumed silica, expanded shale, expanded clay, foamed glass, vermiculite and perlite.

In certain embodiments of the second aspect of the invention, the prefabricated assembly component is a column form assembly having an internal slot adapted to receive a column closure panel assembly.

In certain embodiments of the second aspect of the invention, the integrated structural reinforcement is partially exposed.

A third aspect of the invention is a kit comprising more than one prefabricated assembly component of the invention, including at least two different members selected from the group consisting of a column form assembly, a column closure panel assembly, a beam form assembly, and a slab form assembly.

In certain embodiments of the third aspect of the invention, the shaped form comprises a concrete formulation having a density no greater than 160 pounds per cubic foot and comprising: (a) cement; (b) water; (c) a reinforcing matrix comprising at least one member selected from the group consisting of glass fiber, polyethylene fiber, polyvinylacetate fiber, polypropylene fiber, polyamide fiber and steel wire; and (d) an aggregate comprising at least one member selected from the group consisting of an expanded polymeric foam, hollow glass spheres, hollow ceramic spheres, expanded silica, fumed silica, expanded shale, expanded clay, foamed glass, vermiculite and perlite.

In certain embodiments of the third aspect of the invention, the column form assembly comprises an internal slot adapted to receive the column closure panel assembly.

A third aspect of the invention is a concrete structure comprising more than one prefabricated assembly component of the invention, wherein the concrete structure is a single-story or multi-story building.

A fourth aspect of the invention is a concrete structure prepared by the method of invention, wherein the concrete structure is a single-story or multi-story building.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

Figure 1:
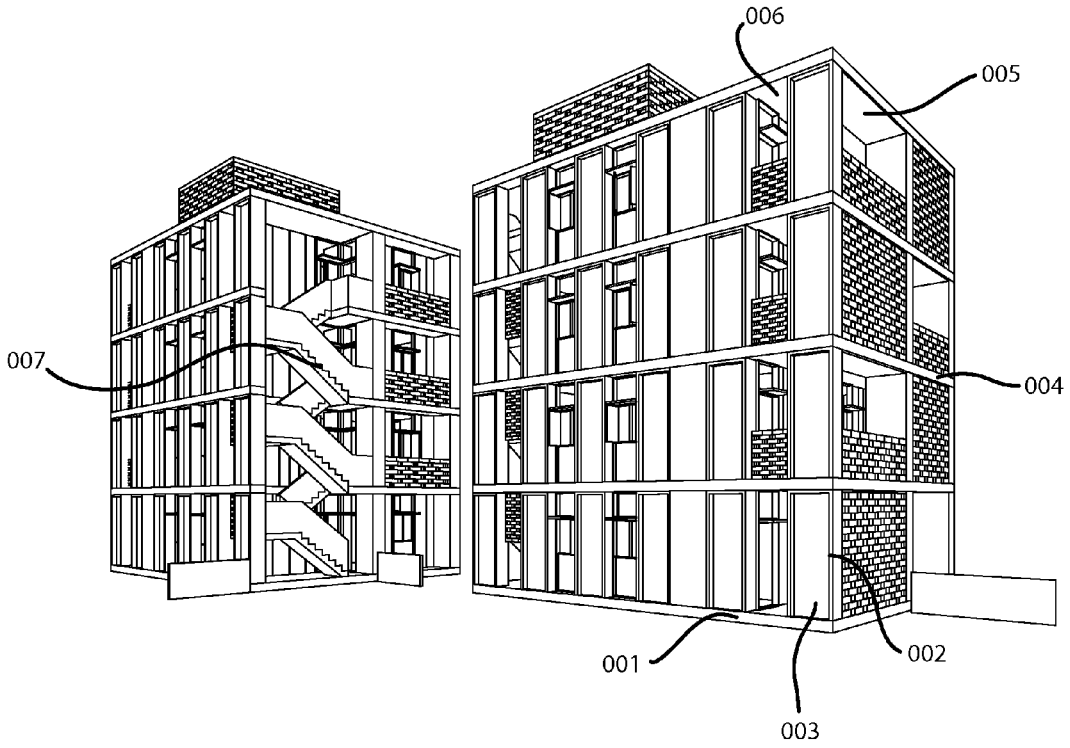
FIG. 1 shows perspective views of embodiments of typical building structures which utilize the present invention.

The present invention is typically applied to the construction of single story and multi-story buildings, such as single-family houses, multi-family residences, commercial properties, and other buildings in which humans can reside, work, gather or the like. Thus, the expression "prefabricated assembly component" as used herein refers to structural elements of such buildings and as such, does not encompass building blocks or structural components for toys and miniature models. FIG. 1 depicts non-limiting examples of buildings, which utilize the present invention. Each building features a 001 slab on grade formed of steel reinforced concrete, which is familiar to those skilled in the art. The typical building is structured of features which are formed from assemblies and methods related to the present invention, such as structural columns 002, 003, structural beams 004, 005, slabs 006 and staircases 007. In addition, other precast structures unrelated to the present invention are typically used in such buildings. Structural columns formed in the typical building comprise a novel permanent formwork as an alternative to conventional removable formwork used for cast in place concrete structures.

Figure 2A:
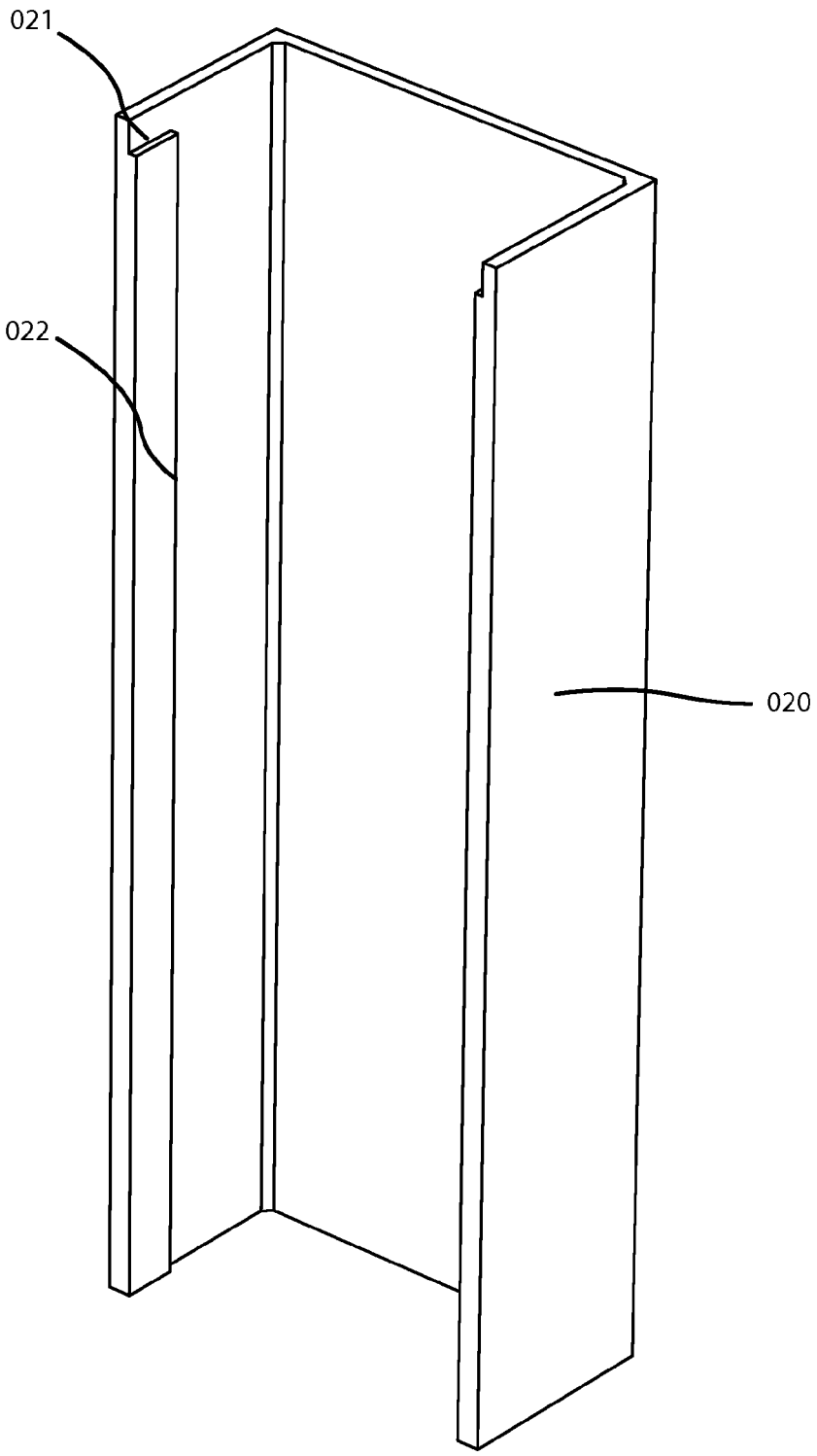
FIG. 2A shows a perspective view of a column form assembly which receives a column closure panel assembly.
Figure 3A:
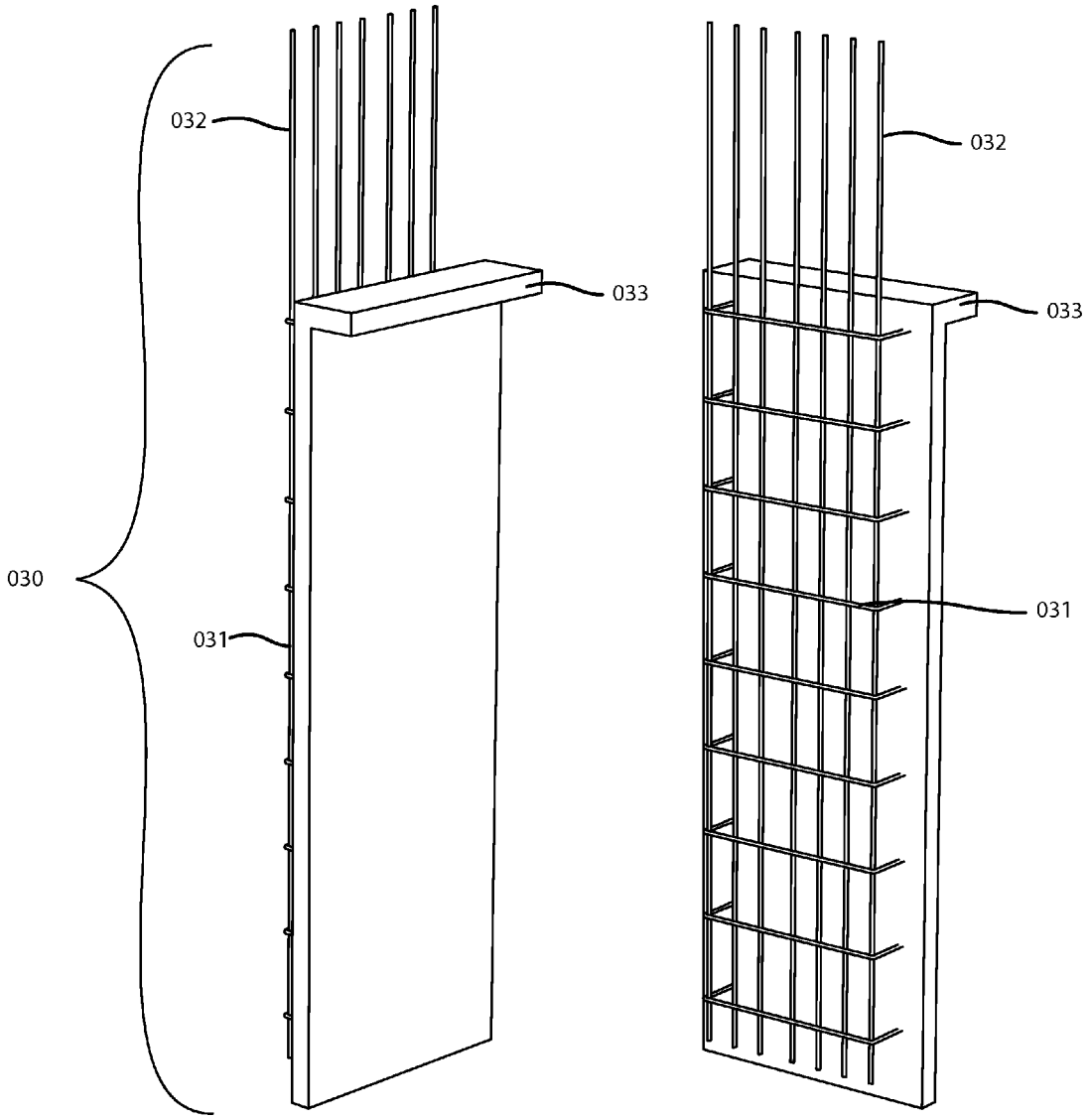
FIG. 3A shows a perspective view of a column closure panel assembly with integral structural reinforcement which is inserted into said column form assembly.
Figure 7:
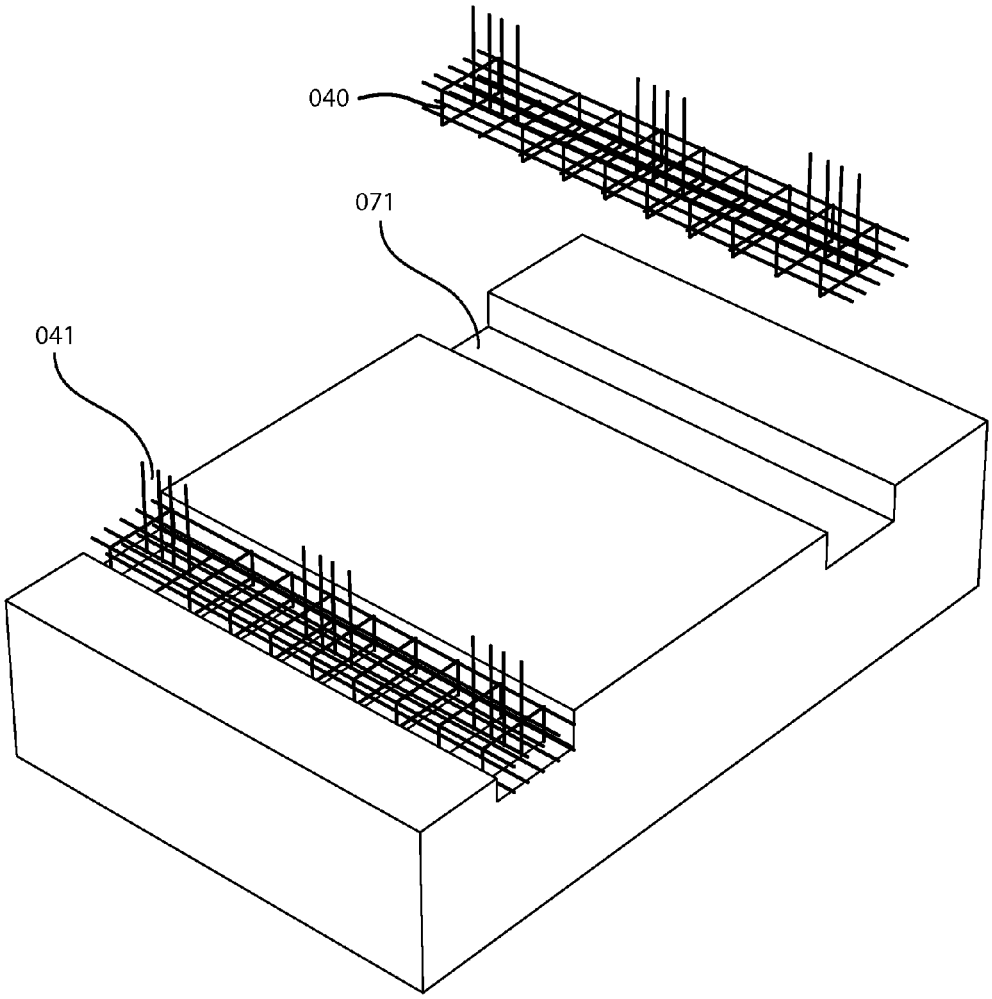
FIG. 7 shows a perspective view of the step of setting a foundation cage into a prepared building site.

Referring to FIGS. 2A and 3A, a column form assembly 020 is preferably cast of concrete reinforced with steel wire or bars; this column form assembly also incorporates a slot 022 and a keying geometry 021 which receives an additional column closure panel assembly 030 which incorporates a structural reinforcement 031 as well as a vertical reinforcement extension 032. This vertical reinforcement extension 032 facilitates a lap splice to an additional column form assembly 020 and column closure panel assembly 030. Lap splices made at grade 071 preferably occur at the foundation reinforcement extension, which is reinforced with a foundation cage 040, a common prefabricated component used by those skilled in the art to reinforce concrete footings for columns and the like, and is not part of the present invention. See FIG. 7.

Figure 2B:
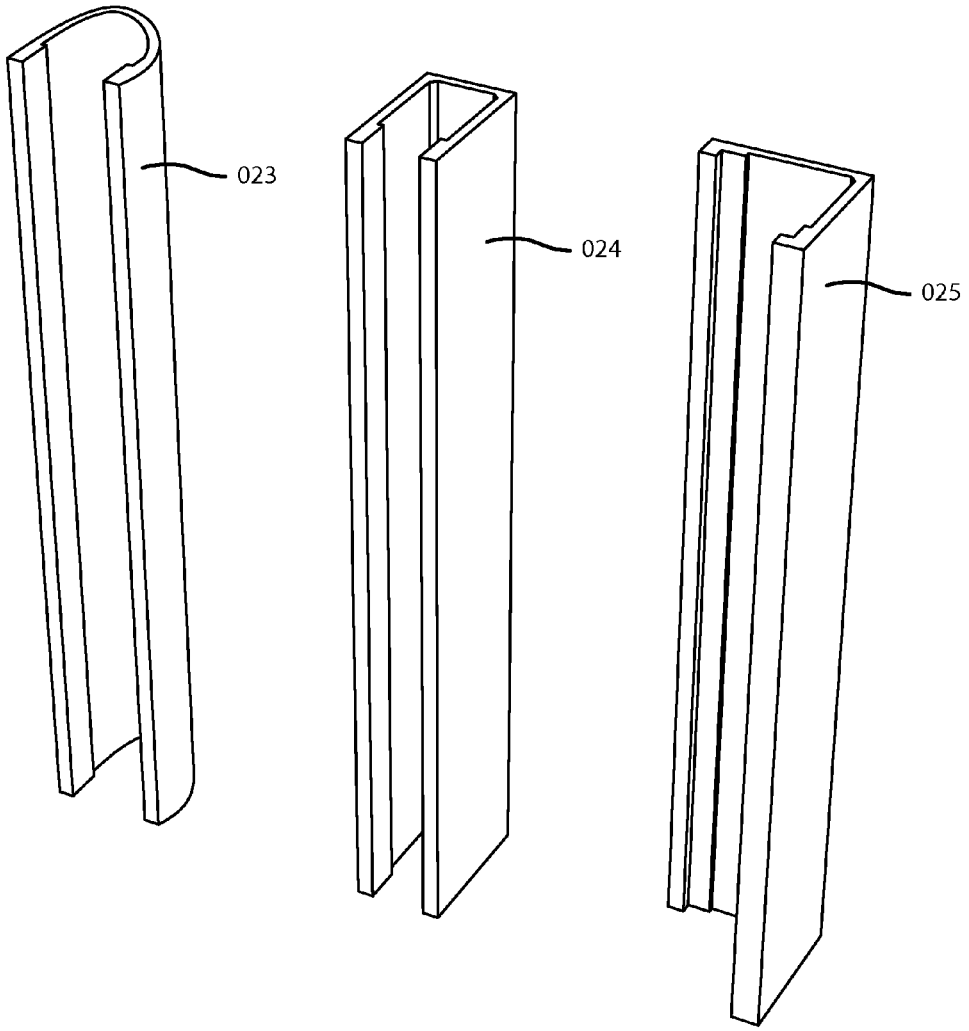
FIG. 2B shows a perspective view of alternative column form assemblies which receive a column closure panel assembly.

FIG. 2B depicts alternative shapes 023, 024, 025 the column form assembly may take. Alternatively shaped and proportioned column form assemblies are within the scope of the present invention.

Figure 3B:
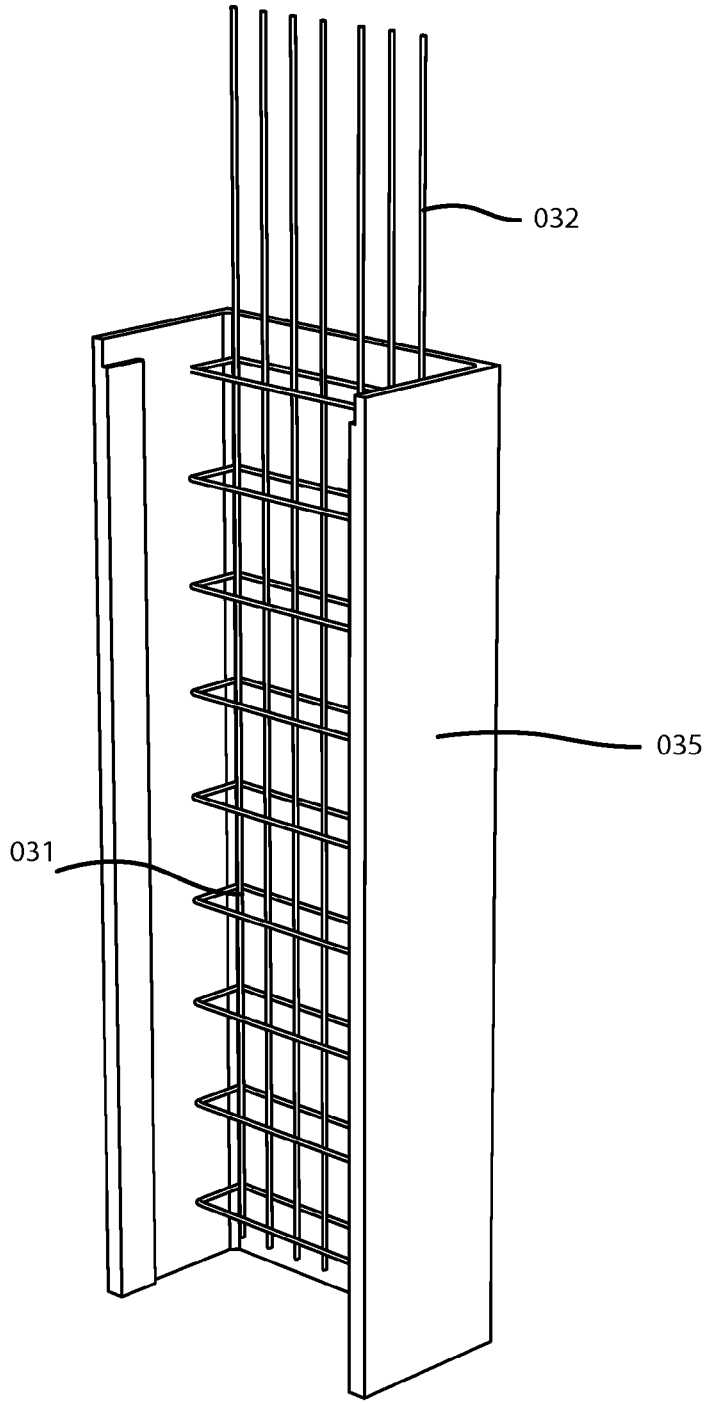
FIG. 3B shows a perspective view of a column form assembly with integral structural reinforcement which receives a column closure panel assembly.
Figure 4:
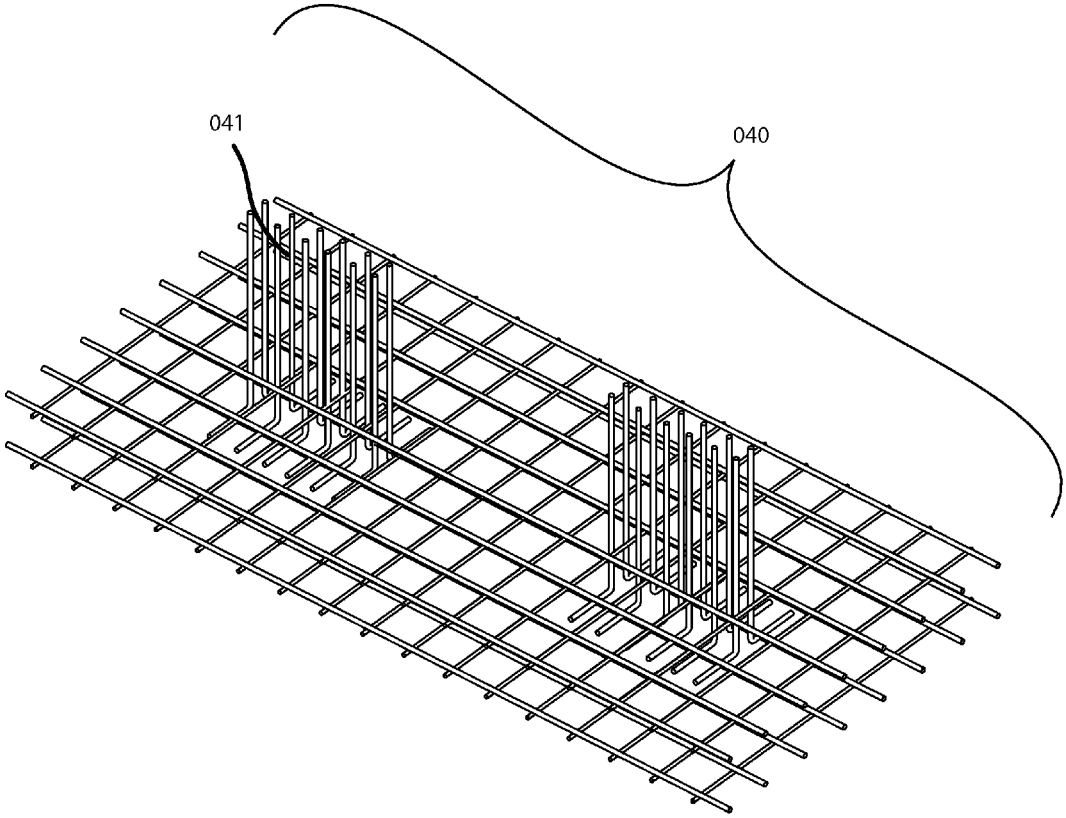
FIG. 4 shows a perspective view of a prefabricated structural reinforcement foundation cage, and is commonly used by those skilled in the art.

FIG. 3B depicts an alternative column form assembly which integrates partially exposed structural reinforcement 031. While the preferred embodiment of the invention integrates the exposed structural reinforcement 031 into the column closure panel assembly 030, an alternative embodiment of the invention integrates this exposed structural reinforcement 031 into the column form assembly 035.

The preferred embodiment of the invention utilizes keying geometries 021, 033, as shown in FIGS. 2A and 3A. Another embodiment of the invention does away with these keying geometries and allows for a column closure panel assembly to be composed of a sheet stock material such as plywood, wood, sheet metal, concrete panel, glass, or other materials of adequate stiffness to withstand the static pressure of the concrete infill.

In the preferred embodiment of the invention, the geometry of the column form assembly 020, 023, 024, 025 is designed to accept an inserted column closure panel assembly by means of an integral slot 022, eliminating the need for temporary clamping and strapping.

Figure 5:
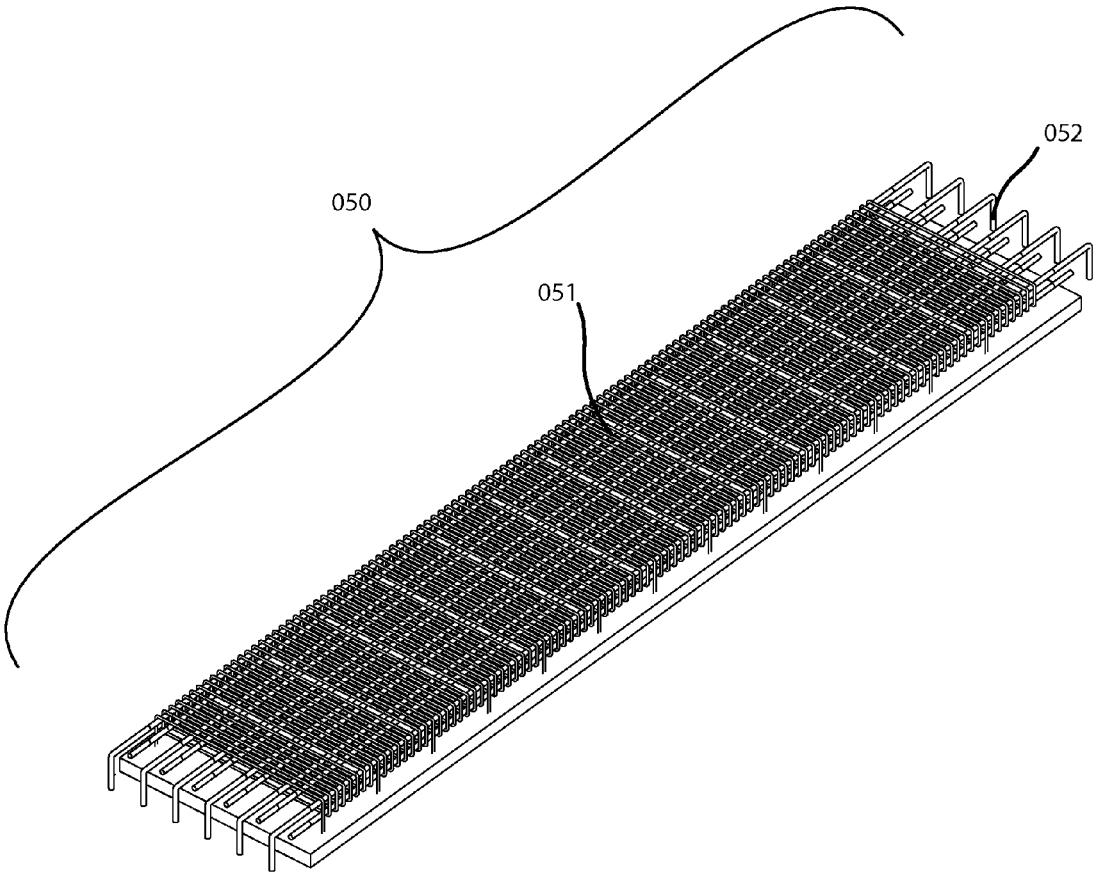
FIG. 5 shows a perspective view of a beam form assembly consisting of a precast panel with integrated beam structural reinforcement and a reinforcement extension.
Figure 6:
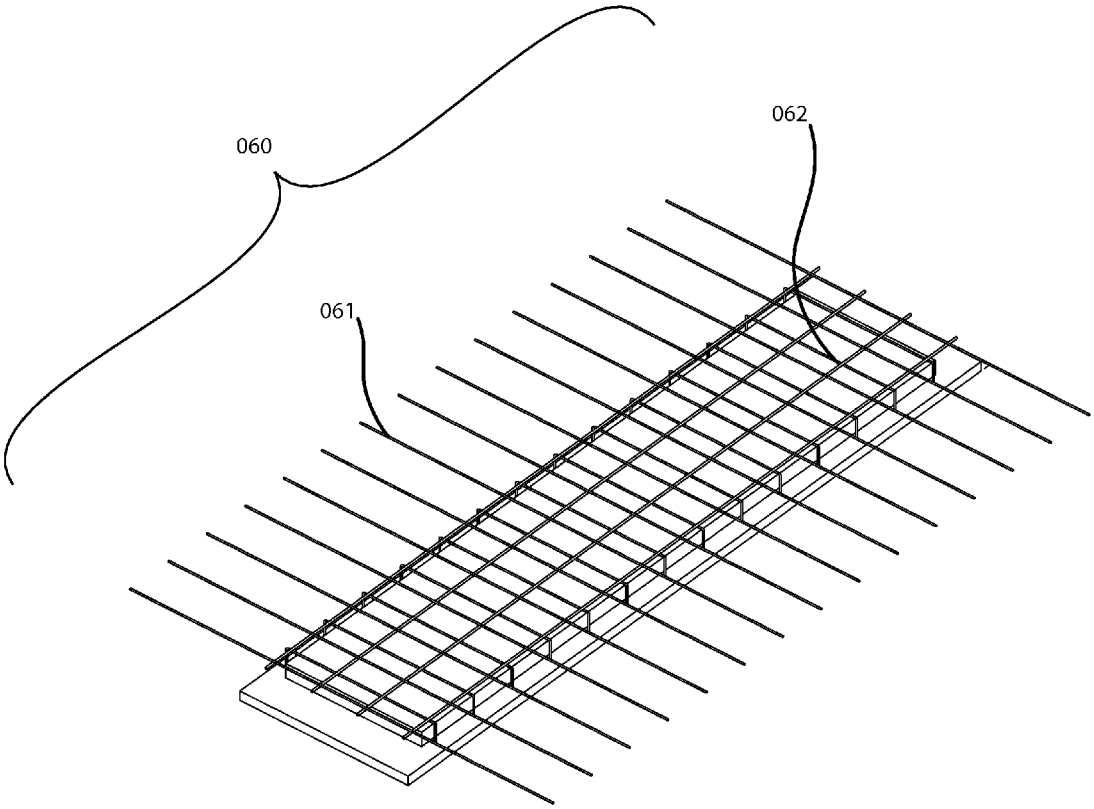
FIG. 6 shows a perspective view of a slab form assembly consisting of a precast panel with horizontal reinforcement extensions.

In addition to columns, the present invention facilitates the construction of beams and floor slabs in single and multi-story constructions. As shown in FIG. 5, a beam is made up of a beam form assembly 050 which incorporates structural reinforcement 051 and a hook reinforcement extension 052. Slabs are formed by spanning the space between beams using a slab form assembly 060, which consists of a cast panel with integral structural reinforcement 062 and a horizontal reinforcement extension 061. See FIG. 6.

Figure 8:
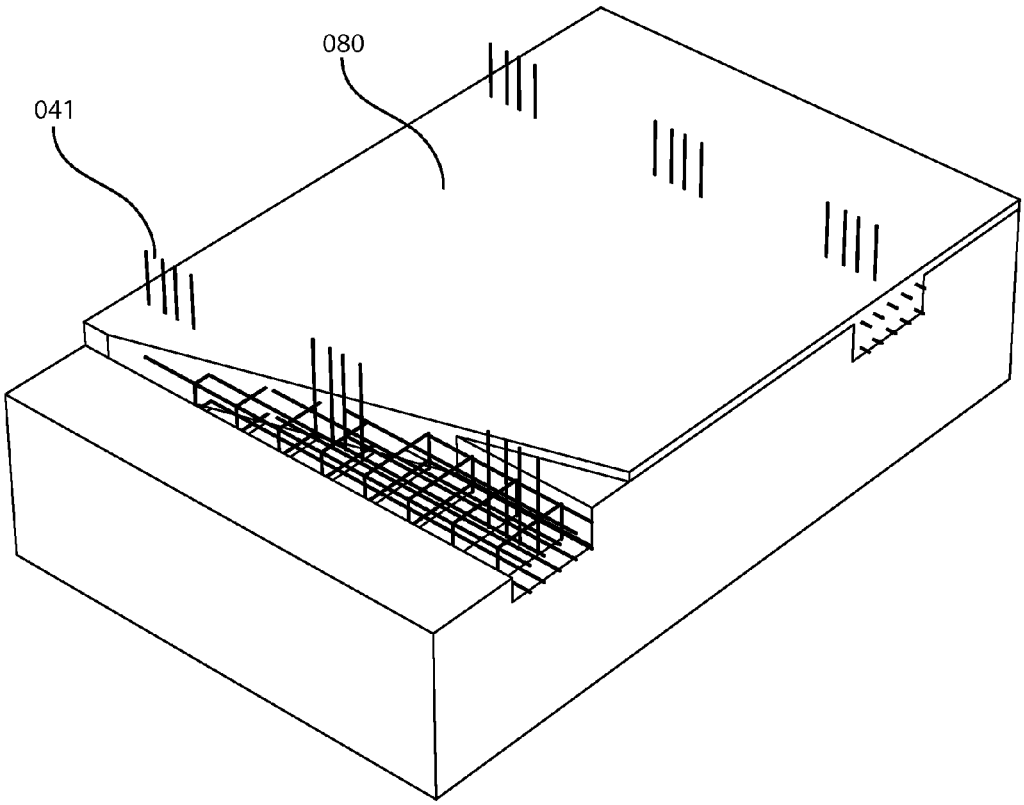
FIG. 8 shows a perspective view of the step of forming a concrete slab on grade over said foundation cages with exposed vertical column reinforcement.
Figure 9:
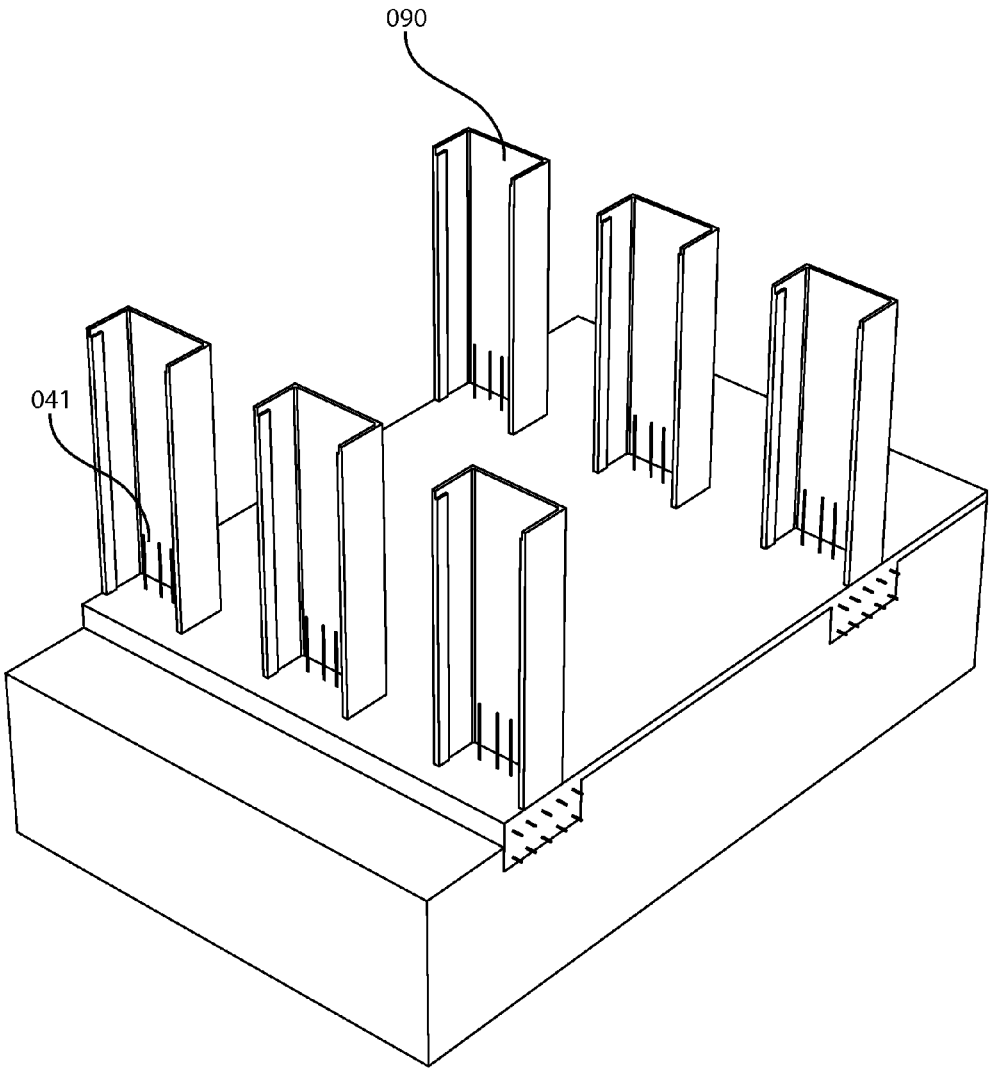
FIG. 9 shows a perspective view of the step of placing said column form assemblies onto said concrete slab in alignment with said vertical column reinforcement.
Figure 10:
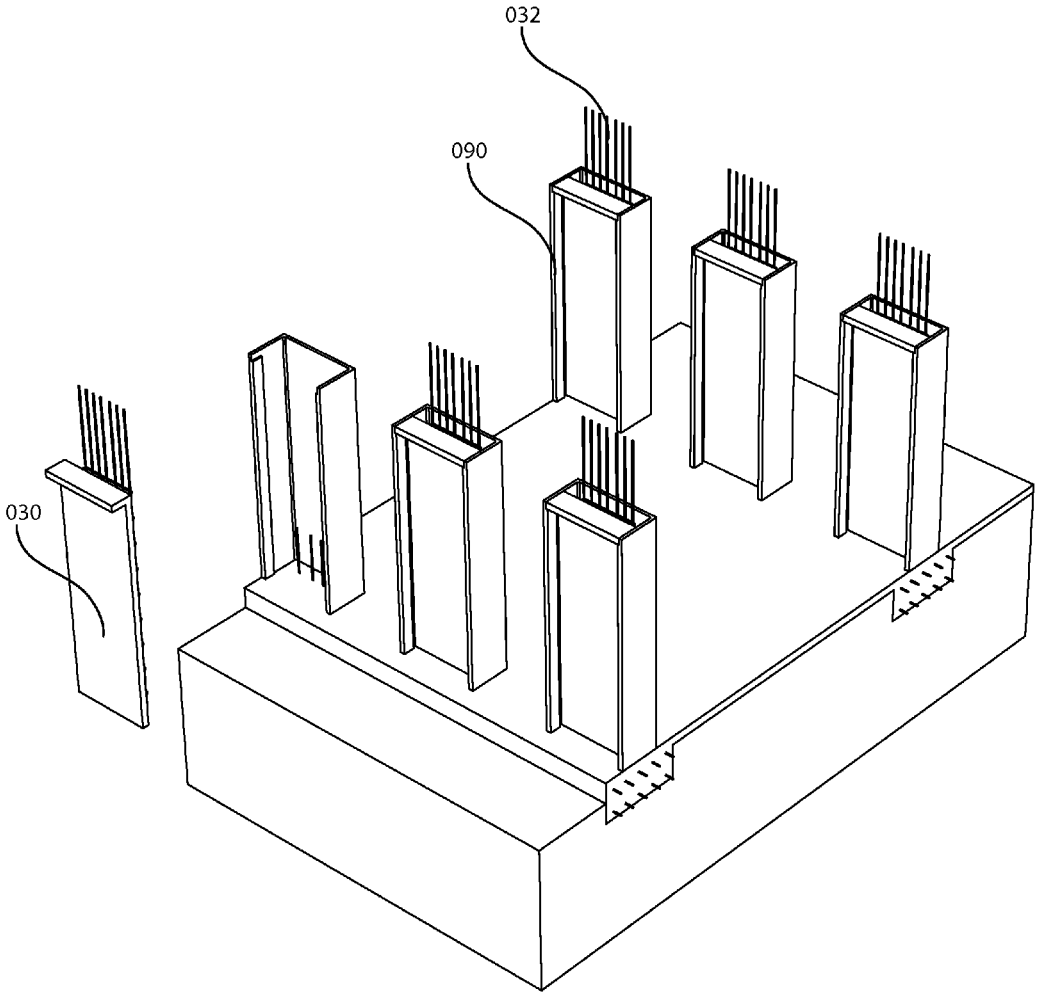
FIG. 10 shows a perspective view of the step of inserting said column closure panel assembly into said column form assembly.
Figure 11:
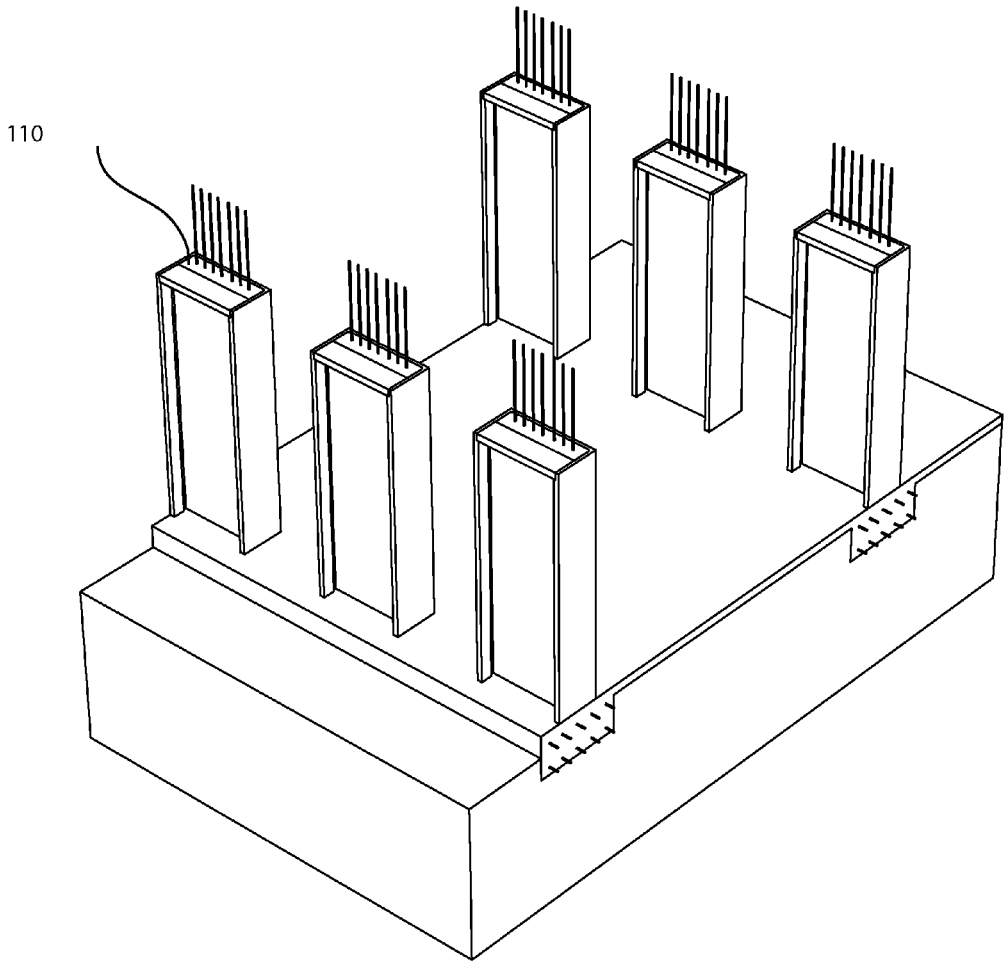
FIG. 11 shows a perspective view of the step of pouring concrete into the cavity formed by said column form assembly and said column closure panel assembly.
Figure 12:
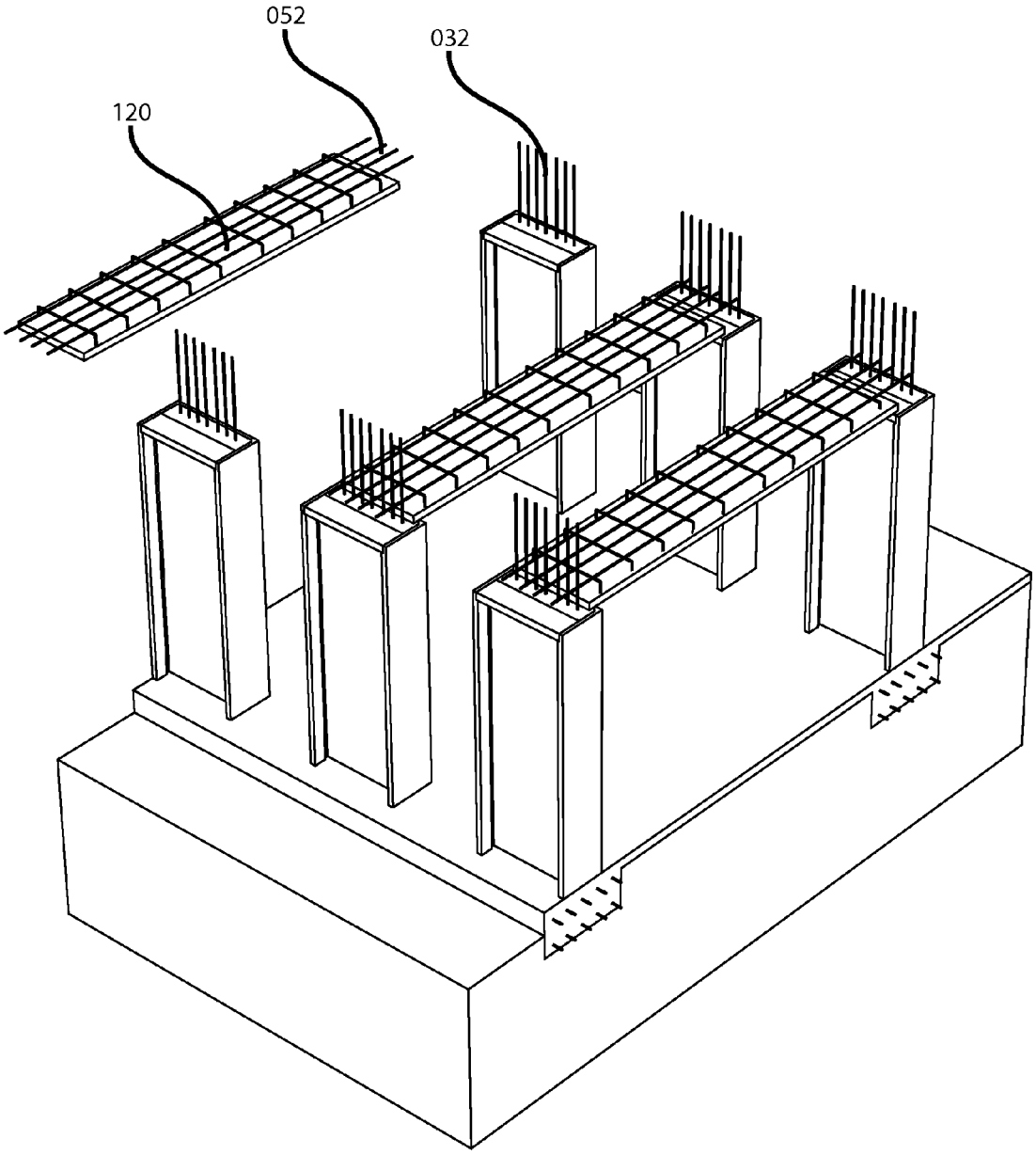
FIG. 12 shows a perspective view of the step of placing said beam form assembly onto said column form assembly and said column closure panel assembly.

Constructing buildings using the present invention involves preparing the site for a foundation and placing the necessary foundation components, such as foundation cage 040. This foundation is designed for the specific site and soil conditions, and is formed of components common to those skilled in the art. A slab on grade 080 is formed over foundation cages 040 to form the ground floor, which preferably incorporates reinforcement extensions 041 from the foundation cages, as shown in FIG. 8. A column form assembly 090 is then placed at each reinforcement extension 041 as shown in FIG. 9, and a column closure panel assembly 030 with an integral vertical column reinforcement 032 is then inserted into the column form assembly 090, creating a cavity 110 into which concrete is poured (FIG. 11). Beam form assemblies 120 are then placed atop the completed columns such that the hook reinforcement extension 052 is in alignment with the vertical column reinforcement 032. See FIGS. 10, 11 and 12.

In a preferred embodiment of the invention, a hook reinforcement extension 052 is used to create a structural splice between the beam and column. Variations on reinforcement extensions common among those skilled in the art, such as loop extensions or straight extensions, may be used in the context of the present invention as well.

Figure 13:
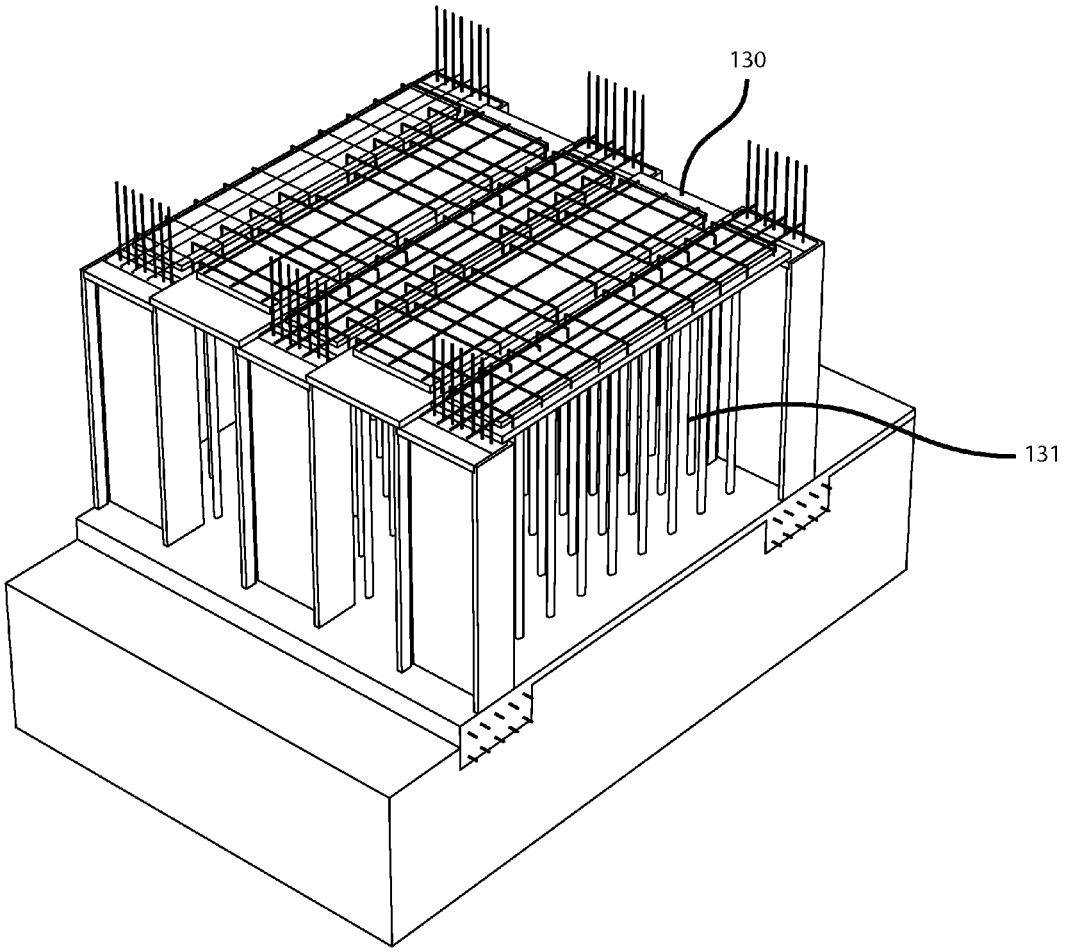
FIG. 13 shows a perspective view of the step of placing said slab form assemblies onto said beam form assemblies as to traverse the gaps between said beam form assemblies.
Figure 14:
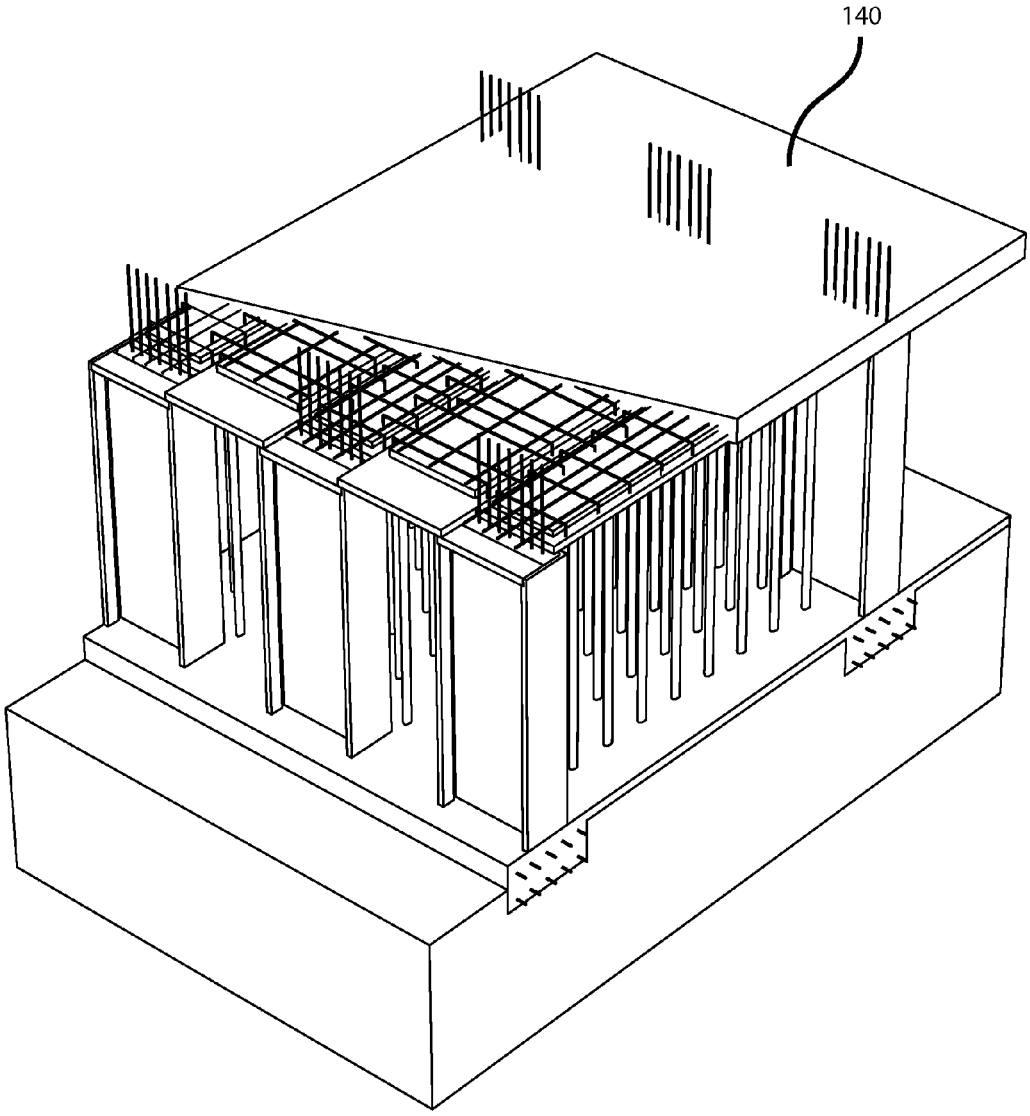
FIG. 14 shows a perspective view of the step of forming a concrete slab over the integral structural reinforcement of said closure panel assemblies, beam form assemblies, and slab form assemblies.
Figure 15:
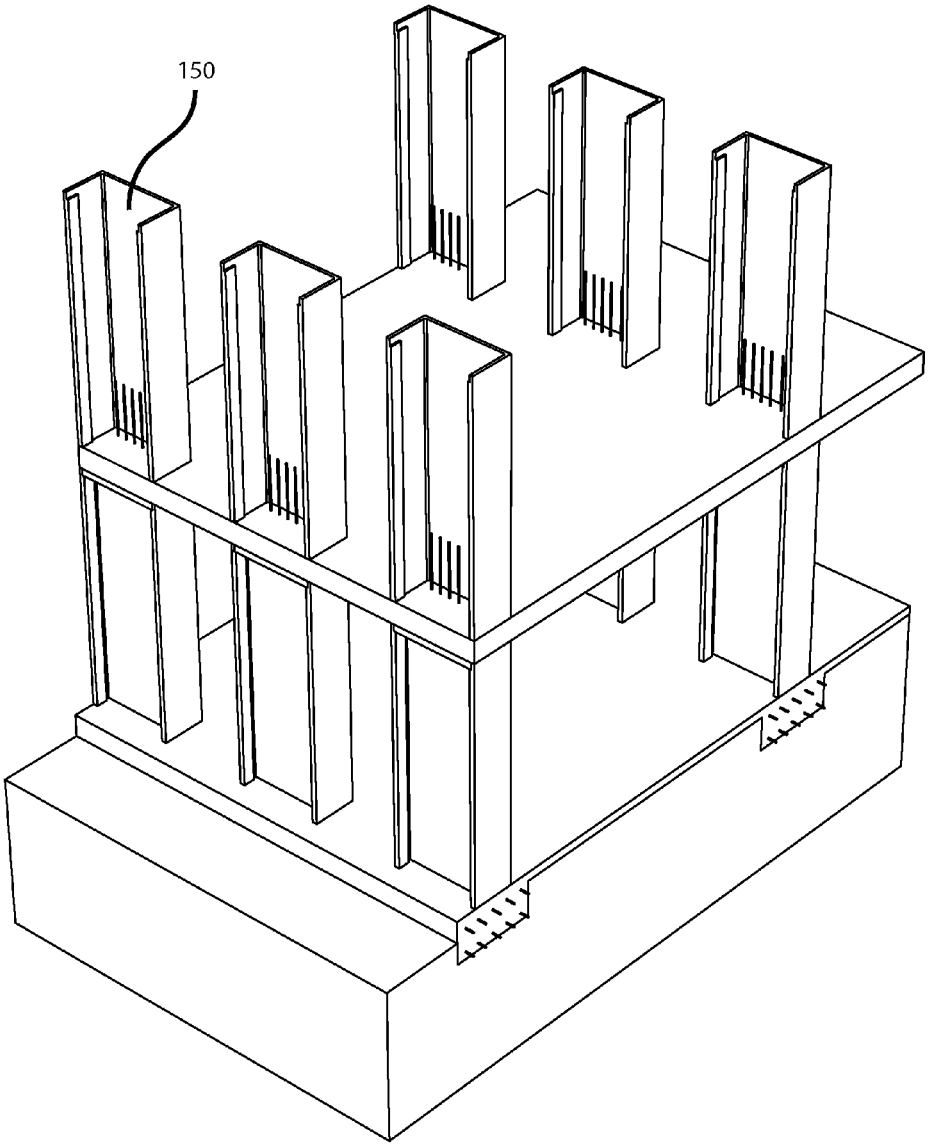
FIG. 15 shows a perspective view of the step of placing said column form assemblies onto concrete slab formed of said beam form and said slab form assemblies.

Completing the formation of beams involves forming a continuous slab, which may incorporate a spanning slab formed of a slab form assembly 130. See FIG. 13. This spanning slab form assembly 130 interfaces to the structural reinforcement 051 of the beam form assembly 050 with horizontal reinforcement extensions 061, which may also be linked together in the field before pouring concrete. In addition, shoring 131 may also provide additional structural support while pouring beams and slabs. It is obvious to one skilled in the art that atria may be formed in the building by excluding a slab form assembly 130. After shoring, slab form assemblies 130, and beam form assemblies 120 are placed, concrete can be poured to form a floor slab 140 which incorporates completed beams and slab. See FIG. 14. Construction may then progress to additional floors using a similar process, beginning with the placement of additional column form assemblies 150. See FIG. 15.

In certain embodiments, other systems such as electrical, plumbing, communications, and heating, ventilation and air conditioning connections are incorporated into prefabricated structural elements.

In certain embodiments, the compressive strength of the concrete available in the field is understood to be significantly lower than the concrete typically used for cast in place structures due to poor quality control or poor craftsmanship. In such embodiments, the structural reinforcement and precast structural elements are designed to handle necessary structural loads anticipating that the infill concrete exhibits a predetermined poor compressive strength. The surface finish and quality of the concrete structure is not compromised since the exposed portions of the concrete consist of precast portions of structural elements.

In certain embodiments, the precast portion of the beam form assembly, slab form assembly, column form assembly, and column closure panel assembly are composed of cast concrete. In a further embodiment, this concrete comprises a lightweight formulation weighing no more than 100 or 160 pounds per cubic foot. In a further embodiment, this lightweight concrete formulation includes an aggregate comprising at least one of an expanded polymeric foam, hollow glass spheres, hollow ceramic spheres, expanded silica, fumed silica, expanded shale, expanded clay, foamed glass, vermiculite, and perlite, a combination of said aggregates, or other lightweight aggregates commonly employed by those skilled in the art. In a yet further embodiment, a reinforcing matrix is incorporated into the concrete mixture, comprising at least one member selected from the group consisting of glass fiber, polyethylene fiber, polyvinylacetate fiber, polypropylene fiber, polyamide fiber and steel wire.

In another embodiment, the beam form assembly, slab form assembly, column form assembly, and column closure panel assembly may be substantially formed of alternative materials to precast concrete, including but not limited to materials such as fiber reinforced plastic (FRP), roto-molded plastic, foamed plastic, molded foam, and other composite materials.

In another embodiment, the prefabricated components incorporate finishing materials which are set in place using said cast concrete. In certain embodiments, the column form assembly incorporates a structural reinforcement in the prefabrication step.

In certain embodiments, the structural reinforcement incorporated into the beam form assembly, slab form assembly, and column closure panel assembly comprises steel (e.g., a perforated steel sheet), carbon fiber reinforced composite, fiberglass reinforced composite, aramid fiber reinforced composite, bamboo, or another structural reinforcement of high tensile strength commonly used by those skilled in the art.

In certain embodiments, said standardized column form assemblies, closure panel assemblies, beam form assemblies, and slab form assemblies incorporate keying geometries 021, 033 which allow components to be combined in only one fashion on site. The specific shape and size of these keying geometries may vary without departing from the spirit of the invention. In certain embodiments, said standardized elements and assemblies can be arranged in any fashion, limited only to the number of vertical floors, without being re-engineered for building specific structural conditions.

While the invention has been described in detail and with reference to specific examples thereof, it will be apparent to one skilled in the art that various changes and modifications can be made therein without departing from the spirit and scope thereof.

What is claimed is:

1. A construction method comprising the following steps:

(a) providing prefabricated assembly components comprising a column form assembly and a column closure panel assembly, wherein the column form assembly is an elongate member C-shaped in cross-section comprising internal slots running longitudinally along a length of the column form assembly on opposing sides thereof, the internal slots constituting keying geometries configured to receive the column closure panel assembly and restrict improper assembly on site;

(b) standing the column form assembly on a slab at a construction site;

(c) inserting the column closure panel assembly into the column form assembly standing on the slab to provide a column form;

(d) casting concrete in the column form to provide a column;

(e) repeating steps (a) through (d) at least once so as to provide a plurality of columns;

(f) positioning prefabricated beam form assemblies on the columns formed in steps (a) through (e); and (g) positioning prefabricated slab form assemblies on the prefabricated beam form assemblies positioned on the columns so as to provide a cast in place concrete structure.

2. The method of claim 1, wherein:

(a) the column form assembly comprises a beam form assembly receiving surface to receive only the beam form assembly; and (b) the beam form assembly comprises a slab form assembly receiving surface to receive only the slab form assembly.

3. A concrete structure prepared by the method of claim 1, wherein the concrete structure is a multi-story building.

4. A concrete structure prepared by the method of claim 1, wherein the concrete structure is a single-story building.

5. The method of claim 1, wherein the method is conducted without temporary fastening, strapping or clamping provisions.

6. The method of claim 1, wherein the walls of the concrete structure are the column forms.

7. The method of claim 1, wherein all walls and all columns of the concrete structure are formed from identical prefabricated column form assemblies and identical prefabricated column closure panel assemblies.

8. The method of claim 1, wherein the concrete structure is a single-story building.

9. The method of claim 1, wherein the concrete structure is a multi-story building.

10. The method of claim 1, wherein at least one of the column form assembly, the column closure panel assembly, the beam form assemblies and the slab form assemblies comprises a shaped form and integrated structural reinforcement, wherein the shaped form comprises at least one formed material selected from the group consisting of concrete, fiber reinforced plastic, and molded plastic.

11. The method of claim 10, wherein the integrated structural reinforcement is applied to the shaped form and partially exposed, allowing for subsequent reinforcement of the concrete cast in the permanent concrete mold.

12. The method of claim 10, wherein the integrated structural reinforcement is applied to the shaped form by casting.

13. The method of claim 10, wherein the integrated structural reinforcement is applied to the shaped form by fastening.

14. The method of claim 10, wherein the integrated structural reinforcement comprises a material selected from the group consisting of steel bars, steel wire, carbon fiber reinforced composite bars, glass fiber reinforced composite bars, aramid fiber reinforced composite bars, bamboo, and perforated steel sheet.

15. The method of claim 10, wherein the shaped form comprises a concrete formulation having a density no greater than 160 pounds per cubic foot and comprising:

cement;

water;

a reinforcing matrix; and an aggregate comprising at least one member selected from the group consisting of an expanded polymeric foam, hollow glass spheres, hollow ceramic spheres, expanded silica, fumed silica, expanded shale, expanded clay, foamed glass, vermiculite and perlite.

16. The method of claim 15, wherein the reinforcing matrix comprises at least one member selected from the group consisting of glass fiber, polyethylene fiber, polyvinylacetate fiber, polypropylene fiber, polyamide fiber and steel wire.

17. A construction method comprising the following steps:

(a) providing prefabricated assembly components comprising a column form assembly and a column closure panel assembly;

(b) standing the column form assembly on a slab at a construction site without temporary fastening, strapping or clamping provisions;

(c) inserting the column closure panel assembly into the column form assembly on the slab to provide a column form, wherein the column closure panel is received within internal slots running longitudinally along a length of the column form assembly, the internal slots constituting keying geometries configured to restrict improper assembly on site;

(d) casting concrete in the column form to provide a column;

(e) repeating steps (a) through (d) at least once;

(f) positioning prefabricated beam form assemblies on columns formed in steps (a) through (e); and (g) positioning prefabricated slab form assemblies on the beam form assemblies so as to provide a cast in place concrete structure.

* * * * *